United States Patent [19]

Drabert et al.

[11] 4,406,496

[45] Sep. 27, 1983

[54] BACKREST FOR CHAIRS

[76] Inventors: Fritz Drabert, Marienstrasse 7, D-4950 Minden; Ulrich H. von Waldegge, Goebenstrasse 51, 4950 Minden (BRR), both of Fed. Rep. of Germany

[21] Appl. No.: 253,629

[22] Filed: Apr. 13, 1981

[30] Foreign Application Priority Data

Apr. 14, 1980 [DE] Fed. Rep. of Germany ..... 3014255

[51] Int. Cl.[3] ..... A47C 3/00

[52] U.S. Cl. ..... 297/284; 297/406; 297/452

[58] Field of Search ..... 297/284, 391, 408, 353, 297/460, 452, 406, 407; 5/437, 446

[56] References Cited

U.S. PATENT DOCUMENTS

| | | | |
|---|---|---|---|
| 1,581,592 | 4/1926 | Neal | 5/437 X |
| 1,639,194 | 8/1927 | Lasater | 297/406 |
| 2,828,810 | 4/1958 | Barecki et al. | 297/408 |
| 2,894,565 | 7/1959 | Conner | 297/284 |
| 3,017,221 | 1/1962 | Emery | 5/437 X |
| 3,463,544 | 8/1969 | Froelich | 297/284 |
| 3,973,797 | 8/1976 | Obermeier et al. | 297/284 |

FOREIGN PATENT DOCUMENTS

| | | | |
|---|---|---|---|
| 2343712 | 5/1974 | Fed. Rep. of Germany | 297/284 |
| 1199756 | 7/1970 | United Kingdom | 297/284 |

*Primary Examiner*—James T. McCall

*Attorney, Agent, or Firm*—Pollock, Vande Sande & Priddy

[57] ABSTRACT

A backrest for chairs, particularly office chairs having a resilient pressure area, the resilient effect of which is adjustable. An adjusting element having a slanted surface is set against the back of the resilient pressure area itself or against a connecting piece. The adjusting element may be a rotatable wheel having a screw-like inclined plane which is centered on the wheel axis.

7 Claims, 4 Drawing Figures

BACKREST FOR CHAIRS

FIELD OF THE INVENTION

The invention is directed to a backrest for chairs, particularly office chairs, having a resilient pressure area.

BACKGROUND OF THE INVENTION

A known backrest of this type has a spinal support in the form of a resilient pressure pad which is disposed so as to be located between the sixth and eighth dorsal vertebra of the person sitting in the chair. Use of this known backrest had led to a reduction in the number of posture problems due to prolonged sitting in office chairs. However, a disadvantage of the known backrest is that the amount of resilience at the resilient area which acts upon the muscles or nerves of the user, is not capable of being adjusted.

BRIEF SUMMARY OF THE INVENTION

The purpose of the present invention is to provide a backrest of the known type wherein the resilient effect of the resilient area is adjustable.

According to the invention, the thickness of the resilient pressure area measured vertically to the chairback, is made variable by means of an adjusting element with a slanted surface which is set against the back of the resilient pressure area itself or against a connecting piece.

It appears most practical to form the adjustment mechanism for adjusting the resilient area at the cervical vertebra area. This has proven to be especially useful for backrests of chairs in work areas which are used at data readout screens.

In a preferred embodiment of the invention, the adjustable area is formed by a turntable/rotatable wheel which is securely mounted in the backrest, which has a screw-like inclined plane which is centered on the axis of the wheel.

It has also been shown to be advantageous for the adjustment wheel to be placed inside the backrest padding with its edge projecting out of the padding.

In a further embodiment of the invention, the adjustment wheel has grooves on its edge.

Finally, the adjustment wheel may be housed in a rearward plastic shell and the connecting piece may be curved convex to the front and then connected to the inclined plane via a rearward projecting cam or the like.

BRIEF DESCRIPTION OF THE DRAWINGS

Hereinafter, a preferred embodiment of the invention is described in detail with aid of the accompanying drawing, wherein.

DETAILED DESCRIPTION OF AN EMBODIMENT

Figure 1:
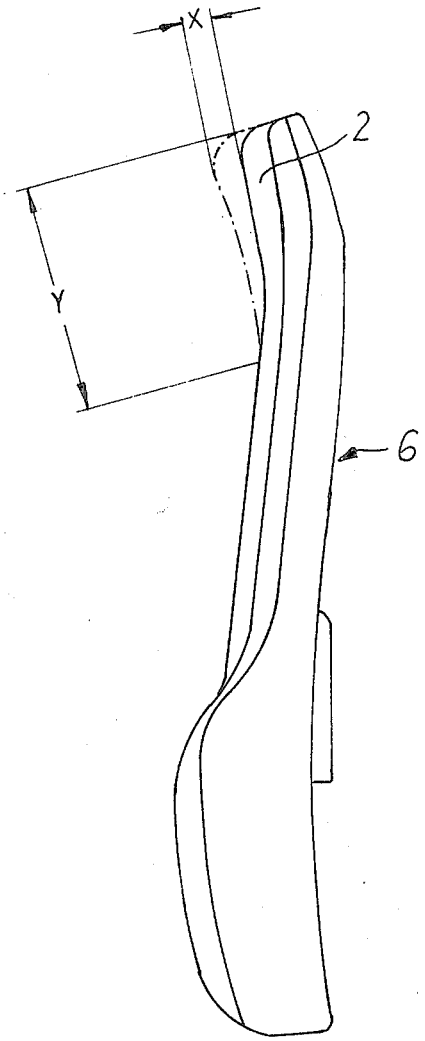
FIG. 1 is a schematic side view of the backrest.

Referring to FIG. 1, the backrest 6 is shown. It has, at its upper end, which is in the area of the cervical vertebra, a resilient pressure area 2, which is thicker toward the front, that is, in the direction of the user of the chair.

Figure 2:
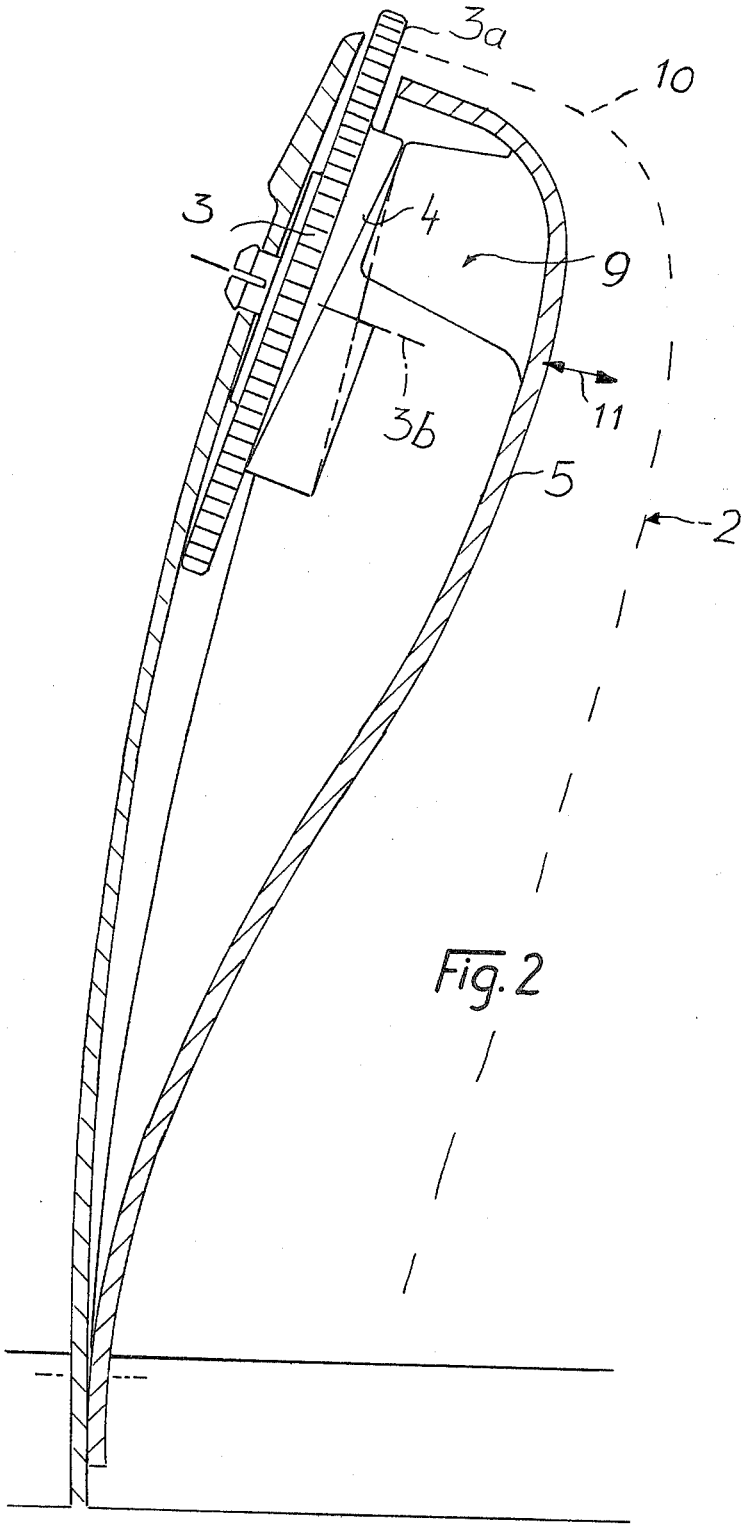
FIG. 2 is a longitudinal cross-sectional view of the upper area of the backrest without padding.
Figure 3:
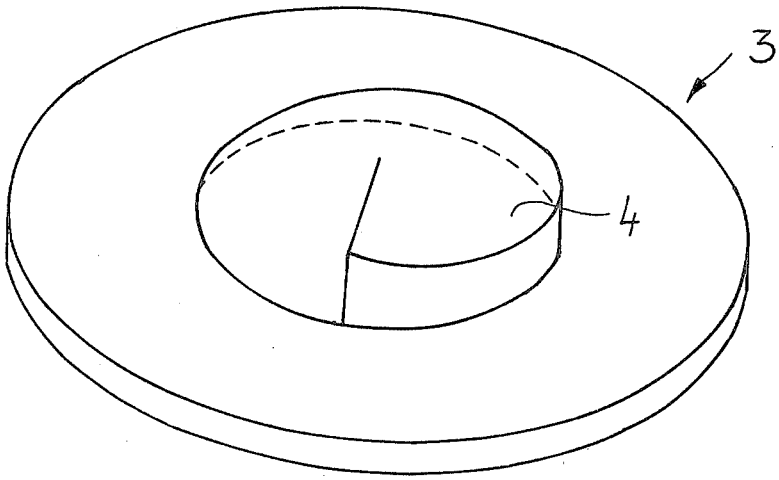
FIG. 3 is a perspective view of the adjustment wheel.
Figure 4:
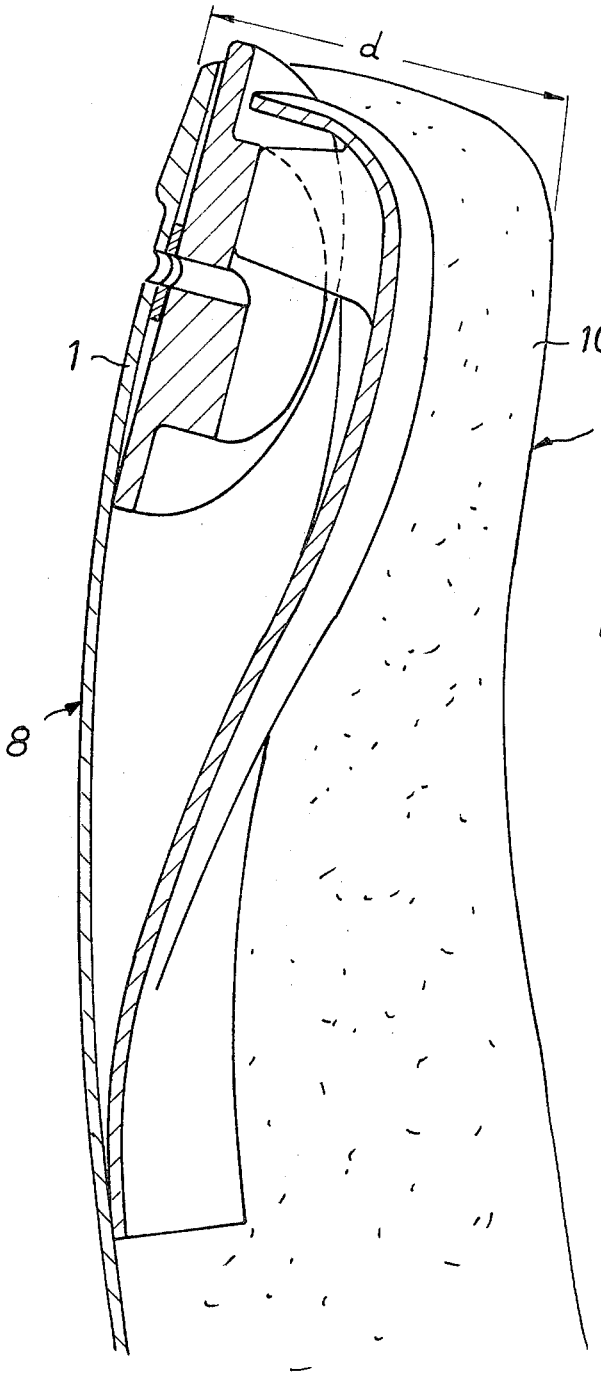
FIG. 4 is a longitudinal cross-sectional view through the backrest and the adjustment wheel with padding shown in schematic form.

Referring to FIGS. 2 and 4, the backrest includes a reverse plastic shell or frame member 8, in which an adjustment wheel 3, stationary and turnable on its axis 3*b*, is positioned. The adjustment wheel has grooves around its edge and protrudes out of the backrest padding 10 with its upper edge. Within the backrest padding 10 there is, in addition to the adjustment wheel, a connecting piece 5, made of a plastic material which is rounded toward the front. On its backside, the connecting piece 5 has a cam follower 9. The cam follower is set against the screw-like inclined plane or cam 4, shown in perspective in FIG. 3, which is centered on the axis 3*b* of the adjustment wheel. When the adjustment wheel 3 is turned, the connecting piece, depending on the direction turned, moves in the direction of the double arrow 11. In this manner, the position of the padding which lies in the area above the connecting piece can be adjusted so that the thickness "d" in FIG. 4 can be varied according to the user's desire.

The resilient pressure area in this design is located at the upper end of backrest 6, and referring to FIG. 1, "x" designates the adjustment area while "y" designates the effective range of the resilient pressure pad.

The described adjustment mechanism can also be used to provide adjustable resilient pressure pads or resilient areas at other places of the backrest.

Further, it should be understood that while we have described certain embodiments of the invention, we do not intend to be restricted thereto, but rather intend to cover all variations and modifications which come within the spirit of the invention, which is limited only by the claims which are appended hereto.

We claim:

1. A backrest for seats or chairs, comprising:
   - a frame member;
   - a resilient pressure pad positioned in front of said frame member for juxtaposition with the back of a person using the seat or chair;
   - adjustment means operatively associated with said frame member and said pressure pad for varying the position of said pressure pad relative to said frame member, said adjustment means comprising a stationary but rotatable element having an axis of rotation and a screw-like inclined cam surface extending around said axis, said cam surface being operatively associated with said frame member and said pressure pad whereby rotation of said element moves said pressure pad toward or away from said frame member.

2. A backrest according to claim 1, wherein said adjustment means is located in the cervical vertebra area of the chair user.

3. A backrest according to claim 1, wherein said rotatable element is a wheel positioned in said backrest between said frame member and said pressure pad.

4. A backrest according to claim 3, wherein said wheel comprises a circumferential edge which projects from said backrest to permit adjustment.

5. A backrest according to claim 4, wherein said wheel has grooves on said circumferential edge.

6. A backrest according to claim 1, wherein said adjustment means comprises a connecting piece positioned between said pressure pad and said inclined cam surface, said connecting piece contacting said cam surface to serve as a cam follower to move said pressure pad in response to rotation of said rotatable element.

7. A backrest according to claim 6, wherein said frame member comprises a plastic shell for said backrest, said rotatable element is mounted on said shell and said connecting piece is rounded in the direction of said person.

* * * * *